US011491492B2

(12) United States Patent
Vermeulen

(10) Patent No.: US 11,491,492 B2
(45) Date of Patent: Nov. 8, 2022

(54) SEPARATION APPARATUS AND METHOD

(71) Applicant: PULSATING JIGS INTERNATIONAL (PTY) LTD, Bredasdorp (ZA)

(72) Inventor: Johannes Jacobus Vermeulen, Swellendam (ZA)

(73) Assignee: PULSATING JIGS INTERNATIONAL (PTY) LTD, Bredasdorp (ZA)

( * ) Notice: Subject to any disclaimer, the term of this patent is extended or adjusted under 35 U.S.C. 154(b) by 0 days.

(21) Appl. No.: 16/972,127

(22) PCT Filed: Mar. 29, 2019

(86) PCT No.: PCT/IB2019/052598
§ 371 (c)(1),
(2) Date: Dec. 4, 2020

(87) PCT Pub. No.: WO2020/035746
PCT Pub. Date: Feb. 20, 2020

(65) Prior Publication Data

US 2021/0229109 A1 Jul. 29, 2021

(30) Foreign Application Priority Data

Aug. 17, 2018 (ZA) ..... 2018/05502

(51) Int. Cl.
*B03B 5/24* (2006.01)
*B03B 5/22* (2006.01)
*B03B 11/00* (2006.01)

(52) U.S. Cl.
CPC ..... *B03B 5/24* (2013.01); *B03B 5/22* (2013.01); *B03B 11/00* (2013.01)

(58) Field of Classification Search
CPC .. B03B 5/24; B03B 5/22; B03B 11/00; B03B 5/10; B03B 5/12
See application file for complete search history.

(56) References Cited

U.S. PATENT DOCUMENTS 228,465 A 6/1880 Lauder
1,225,158 A * 5/1917 Moyer ..... B03B 5/18 209/427

(Continued)

FOREIGN PATENT DOCUMENTS

CN 1717281 A 1/2006
GB 263423 A 12/1926

(Continued)

OTHER PUBLICATIONS

Eichholz G et al: "The Compensator Pulsator Jig—A Further Development of the Membrane Pulsator Jig", at Mineral Processing, Bauverl. BV, DE, vol. 39, No. 3, Mar. 1998 (Mar. 1, 1998), p. 124.

(Continued)

*Primary Examiner* — Michael McCullough
*Assistant Examiner* — Jessica L Burkman
(74) *Attorney, Agent, or Firm* — Meunier Carlin & Curfman LLC

(57) ABSTRACT

A separation apparatus and method for separating ore is provided. The separation apparatus (10) includes a separation chamber (12) and is configured to be utilised with a fluid pulsing mechanism (32) for operatively pulsating a fluid through ore deposited in the chamber resulting in the migration of generally lighter ore particles toward an upper region (25) of the chamber and for generally heavier particles to migrate toward a bottom region (14) of the chamber (12). The ore is deposited by means of a chute (38) in the bottom region (14) of the chamber (12) and the lighter ore particles may then be extracted from the chamber through a first (Continued)

chamber outlet (24) while the heavier particles may be extracted through a second chamber outlet (28).

15 Claims, 5 Drawing Sheets

(56) References Cited

U.S. PATENT DOCUMENTS

| | | | | |
|---|---|---|---|---|
| 1,327,537 | A | 1/1920 | Elmore | |
| 14,770,066 | | 12/1923 | Knapp | |
| 2,196,451 | A * | 4/1940 | Holzer | B03B 11/00 209/17 |
| 2,819,797 | A * | 1/1958 | Woodhead | B03B 5/24 209/455 |
| 2,948,397 | A | 8/1960 | Johnson | |
| 4,778,219 | A | 10/1988 | Wilczynski et al. | |
| 7,571,815 | B2 * | 8/2009 | Pufal | B03B 5/18 209/13 |

FOREIGN PATENT DOCUMENTS

| | | | |
|---|---|---|---|
| RU | 2238150 | C2 | 10/2004 |
| SU | 129564 | A1 | 11/1959 |
| SU | 1304878 | A1 | 4/1987 |
| SU | 1734848 | A1 | 5/1995 |

OTHER PUBLICATIONS

Marx G et al: "Dichtesortieren Auf Nassetzmaschinen", at Mineral Processing, Bauverl. BV, DE, vol. 40, No. 5, May 1999 (May 1, 1999), pp. 215-218.

International Search Report and Written Opinion issued in PCT/IB2019/052598, dated Jul. 4, 2019, 11 pages.

First Office Action dated Jun. 30, 2022 in Chinese Application No. 2019800691458 (10 pages).

Official Action issued in Russian Application No. 2021106705 dated Jun. 17, 2022 (17 pages).

Fomenko T.G. "Gravity processes of mineral processing" (Category A).

* cited by examiner

SEPARATION APPARATUS AND METHOD

CROSS-REFERENCE(S) TO RELATED APPLICATIONS

This application claims priority from South African provisional patent application number 2018/05502 filed on 17 Aug. 2018, which is incorporated by reference herein.

FIELD OF THE INVENTION

This invention relates to the field of mineral processing and, in particular, it relates to the separation of minerals found in ores.

In this specification "ore" has its widest meaning and includes any naturally occurring solid material from which minerals of economic interest may be extracted.

BACKGROUND TO THE INVENTION

Excavated mineral ores from rock require mineral processing, also known as ore dressing, the main objective of which involves separation of valuable minerals from the waste material. This may typically involve particle size reduction; separation of particle size by screening or classification or concentration, which employs physical and surface chemical properties and solid/liquid separation.

Examples of commonly known valuable minerals include: gold, gemstones, diamonds, placer tin, copper, coal and the like. Most of the latter examples are extracted from mineral ores by the use of devices that are referred to in the art as jig concentrators. Jig concentrators are devices utilized in mineral processing to separate particles within the ore body based on their specific gravity, size, shape and density.

Particles of ore are introduced to a so-called jig bed where they are thrust upward by a pulsing fluid body. Water is the most common fluid that is used, however, additives that aid separation may be added. The pulsing water thrusts the particles upward resulting in some of the particles being suspended within the water. As the pulse dissipates, the water level returns to its lower starting position, whereafter the particles once again settle on the jig bed. As the particles are exposed to gravitational force whilst suspended within the water, heavier particles (with a higher specific gravity) settle faster than lighter particles resulting in a concentration of heavier particles at the bottom on the jig bed. The heavier particles may then be extracted from the jig bed, whereas lighter particles may be extracted from an upper region of the jig.

Commonly available concentrator jigs typically have large tanks or receptacles housing a bed on which anything from 3 tonnes of solid material to as much as 100 tonnes per hour, may be processed, depending on size. Moreover, these large tanks are coupled to loading and collection mechanisms which may include conveyor belts and support beams. The tanks also require a correspondingly effective fluid pulsing mechanism capable of providing a pulse sufficient to lift the ore particles in the tank. In known jig concentrators the ore is introduced at a top opening of the device requiring the tank of the device to be very large to enable the particles to settle properly.

Accordingly, the commonly available concentrator jigs are quite large overall, typically having one or more tanks large enough to house several cubic meters of ore and water. Similarly, due to the size of the tanks, the jigs consume large volumes of water and a large volume of water is in the tank at any given point in time, requiring a substantial amount of force to pulsate the water. This, in turn, requires a very large pump and mechanical components. Moreover, due to the significantly large pulsing mechanism required to pulse the water in the large tanks, the jigs consume a lot of electricity. Finally, due to the size of the jigs, the use thereof is generally confined to operation on land only in immobile environments.

There is accordingly a need for a separation apparatus and method which alleviates the abovementioned problems at least to some extent.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with the invention there is provided a separation apparatus comprising:

a separation chamber having a permeable separator member located near a bottom region thereof, a first chamber outlet located near an upper region of the chamber and a second chamber outlet located near the bottom region of the chamber, the chamber being configured to be utilised with a fluid pulsing mechanism for operatively pulsating a fluid through ore deposited in the chamber resulting in the migration of generally lighter ore particles toward the upper region of the chamber and for generally heavier ore particles to migrate toward the bottom region of the chamber, characterised in that an ore deposit chute is provided through which ore may be deposited near the bottom region of the chamber remote from the first chamber outlet, with the chute outlet being disposed lower in the chamber than the first chamber outlet.

Further features provide for the chute to include an inlet and an outlet; for the chute to taper outwardly from the inlet toward the outlet thereof; for the inlet of the chute to be configured to receive a trough, conveyor mechanism or the like for feeding ore into the chute; for at least part of a lower part of the chute to be operatively submerged in the pulsating fluid, preferably for the chute outlet to be operatively submerged in the pulsating fluid; for the chute to extend through the chamber from the upper region thereof to the bottom region thereof, alternatively for the chute to be provided externally of the chamber and for the chamber to include an inlet in communication with the outlet of the chute so as to enable depositing of ore near the bottom region of the chamber through the outlet of the chute.

Even further features provide for the separator member to define a bottom of the chamber; for the separator member to be secured within the chamber at an angle relative to a top of the chamber, alternatively for the separator member to be secured within the chamber at an angle relative to the first outlet; for the separator member to be permanently secured within the chamber at a preselected angle, alternatively for the separator member to be at least partially rotatable so as to enable adjustment of the angle relative to the top of the chamber, relative to the first outlet of the chamber or relative to the outlet of the chute; and for the separator member to be in the form of a permeable plate through which pulsating fluid may be pulsed.

Yet further features provide for the second chamber outlet to be located on the same side of the chamber as the first chamber outlet; alternatively, for the second chamber outlet to be located on a side of the chamber opposite or remote from that of the first chamber outlet; for a blanking off plate to be provided within the chamber that is configured to reduce the size of the chamber while maintaining the pulse volume thereby increasing the pulse length; and for the location of the second chamber outlet to be selected depending on the angle of the separator member relative to the first outlet of the chamber.

Still further features provide for the fluid pulsing mechanism to pulsate fluid mechanically, alternatively hydraulically by means of a flexible diaphragm or air operating on a fluid surface or a combination thereof; for the fluid pulsing mechanism to be configurable so as to configure the velocity of the pulsed fluid; and for the velocity of the pulsed fluid to be selected depending on the specific gravity and particle size of the material to be separated.

In accordance with this invention there is provided a method of separating ore by means of a separator apparatus, the method including the steps of:

introducing ore into a separation chamber of a separator apparatus, the ore being introduced through a chute having an outlet disposed lower in the chamber relative to a first chamber outlet so that the ore is introduced through the chute outlet into the chamber near an operatively bottom region of the chamber; and pulsating a fluid through ore introduced into the chamber resulting in the migration of generally lighter ore particles toward an upper region of the chamber and the migration of generally heavier ore particles toward the bottom region of the chamber.

Further features provide for the first chamber outlet to be provided in the upper region of the chamber and for a second chamber outlet to be provided in the bottom region of the chamber and for the method to include the steps of extracting or discharging the generally lighter ore particles through the first chamber outlet and the generally heavier ore particles through the second chamber outlet.

An embodiment of the invention will now be described, by way of example only, with reference to the accompanying drawings.

DETAILED DESCRIPTION WITH REFERENCE TO THE DRAWINGS

Figure 1:
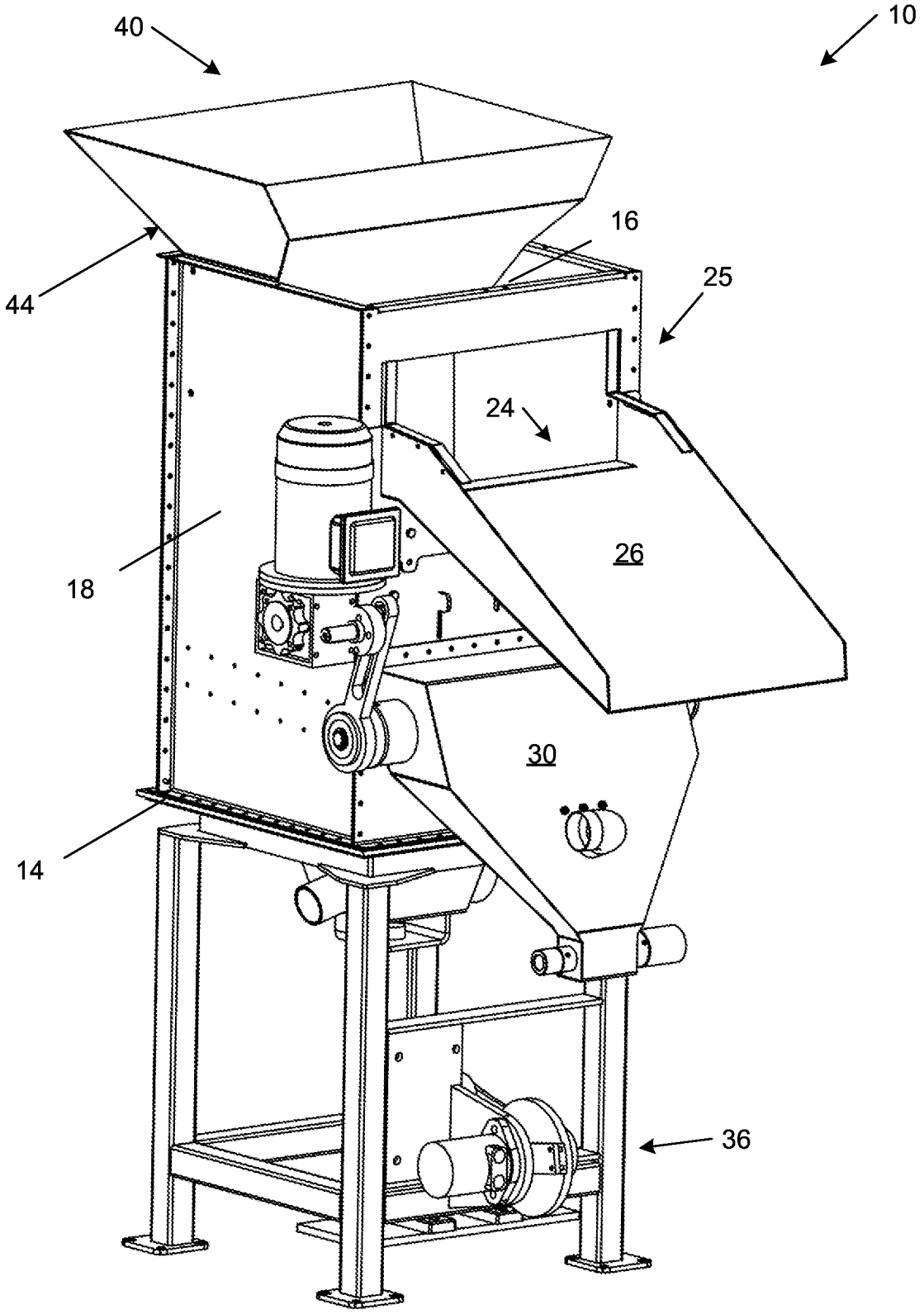
FIG. 1 is a three-dimensional view of a separation apparatus according to an embodiment of the invention.
Figure 2:
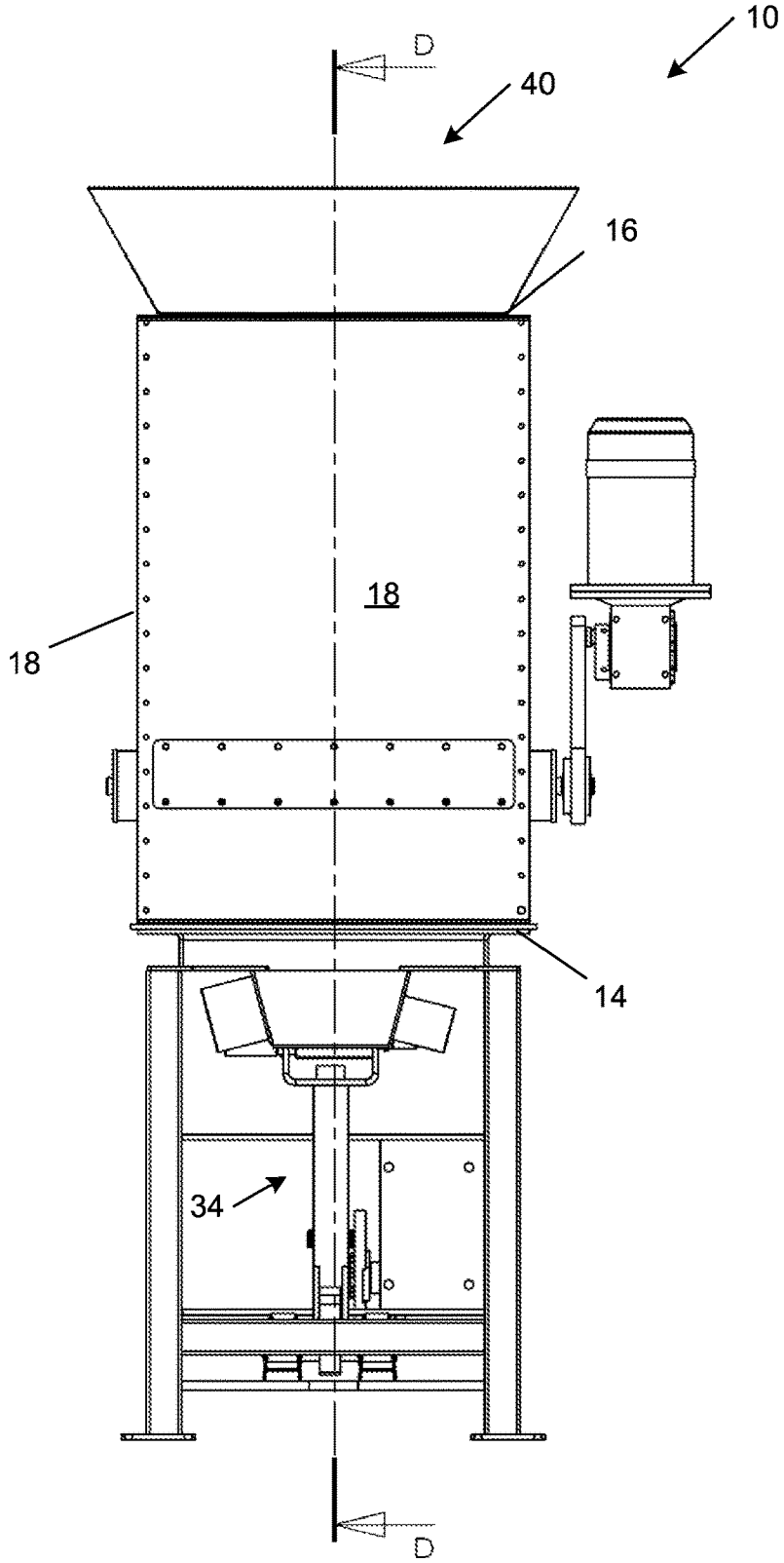
FIG. 2 is a side view of the separation apparatus of FIG. 1.
Figure 3:
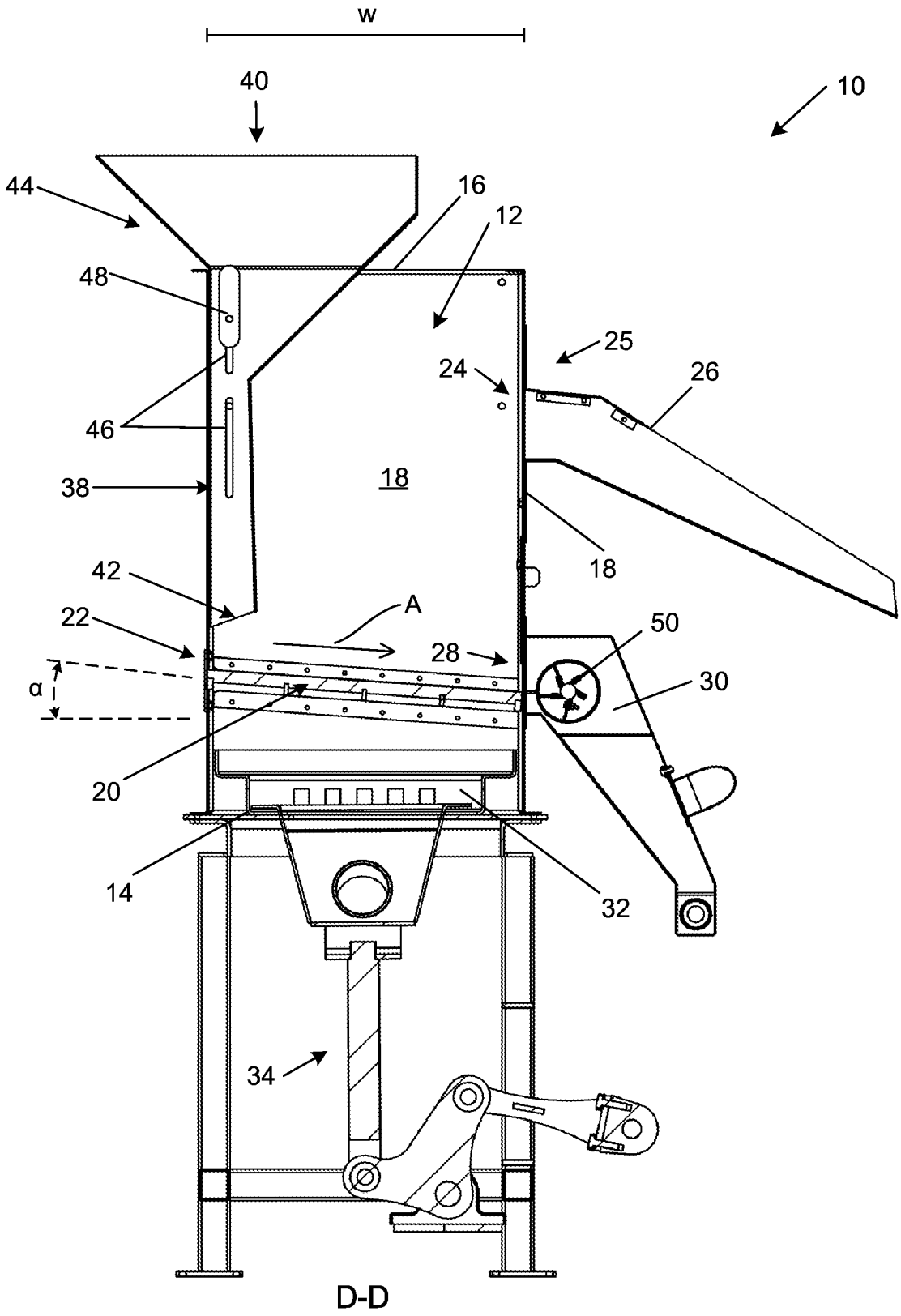
FIG. 3 is a sectional view of the separation apparatus along line D-D in FIG. 2, illustrating a separation chamber and a chute for receiving ore.
Figure 4:
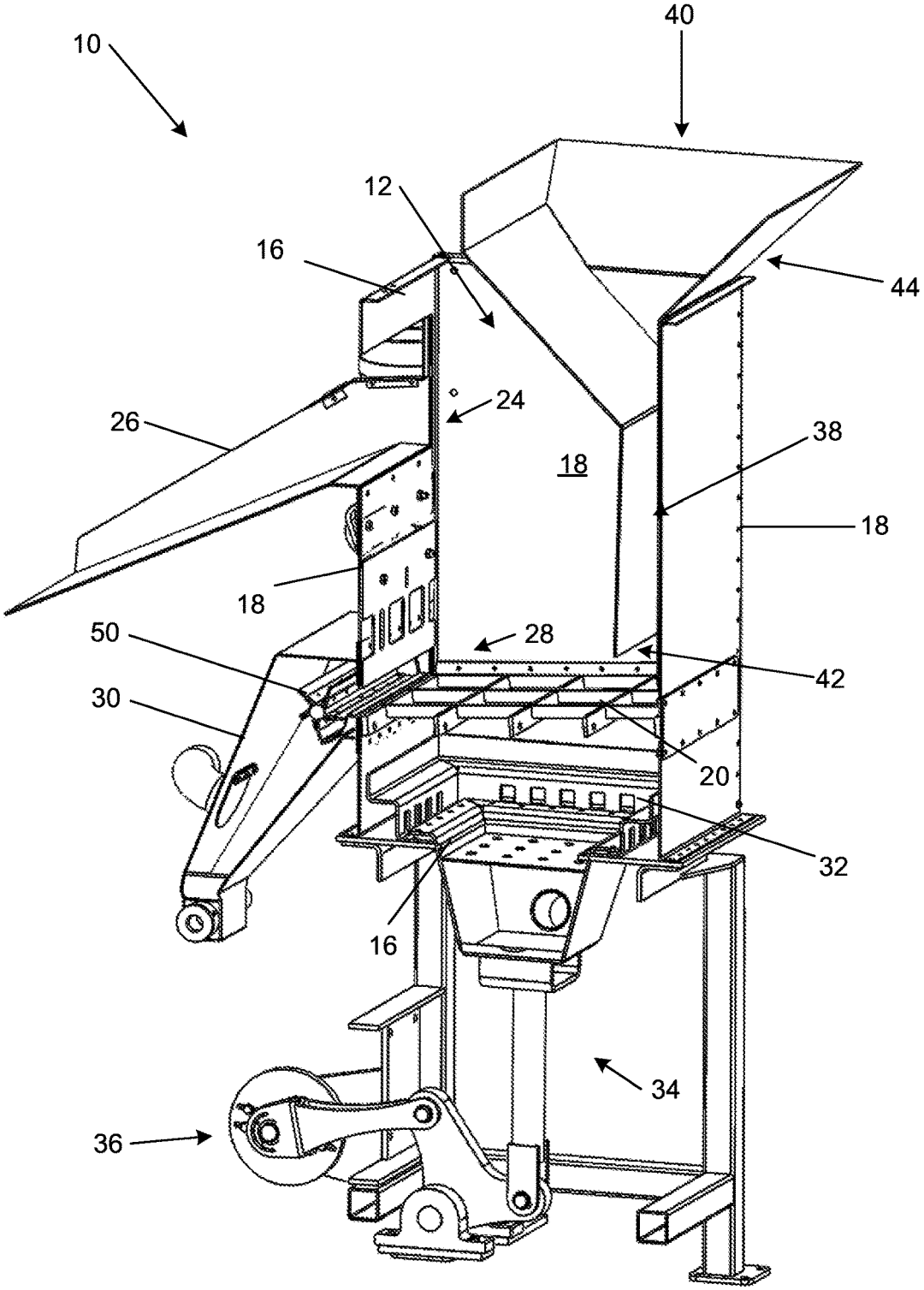
FIG. 4 is a three-dimensional sectional view of the separation apparatus also along line D-D in FIG. 2, but viewed from an opposite side than FIG. 3.

An example embodiment disclosed herein provides a separation apparatus. The apparatus may include a separation chamber having a permeable separator member disposed near a bottom region thereof. The permeable separator member may form a grid surface or other support that may support ore deposited into the separation chamber. The chamber may include a first outlet located near an upper region of the chamber and a second outlet located near the bottom region of the chamber. The two outlets may be disposed on the same wall of the chamber, alternatively the two outlets may be disposed on opposing walls of the chamber. The separation apparatus may include a fluid pulsing mechanism disposed near the bottom region of the chamber, below the separator member, for pulsating a fluid through the separator member and any ore deposited in the chamber. This pulsation may result in at least some of the ore becoming suspended in the fluid and may cause the migration of generally lighter ore particles (that may have generally lower specific gravity) toward the upper region of the chamber where the particles may be extracted from the chamber through the first outlet and generally heavier ore particles (that may have generally higher specific gravity) to migrate toward the bottom region of the chamber where the particles may be extracted from the chamber through the second outlet. The separation apparatus or jig concentrator may have an ore deposit chute through which, in use, ore may be deposited near the bottom region of the chamber, preferably directly onto the separator member, generally opposite the first outlet and remote from a top of the chamber. The chute's outlet may be disposed lower in the chamber relative to the first outlet. It will be appreciated that since ore may be deposited near the bottom region of the chamber and lower in the chamber relative to the first outlet, the heavier particles will no longer need to migrate to the bottom region and only the generally lighter particles will migrate through the generally heavier particles to the upper region of the chamber. This aspect allows for a significantly thicker layer of ore to be supported on the separator member than in current systems known in the art, as will be described in more detail further below. In addition, this aspect allows for a significantly higher ore throughput per area of the separation chamber as may be provided by known systems.

The chute may taper or have a funnel-like shape toward the outlet thereof to facilitate the flow of ore therethrough. Making use of a chute that tapers outwardly from its inlet toward its outlet results in ore being drawn through the chute into the chamber due to the ore being compressed into the tapering chute on the upward stroke of the fluid pulsing mechanism, while being drawn downwardly toward the outlet of the chute during the downward stroke of the pulse.

The inlet of the chute may be configured to receive a trough, conveyor mechanism or the like for feeding ore into the chamber via the chute. The chute may be in the form of a hopper. Further, the chute may extend internally of the chamber from the upper region thereof to the bottom region thereof, alternatively, the chute may be provided externally of the chamber in which case the chamber may include an inlet in communication with the outlet of the chute.

The separator member may be secured within the chamber at an angle relative to the top of the chamber or relative to the first outlet of the chamber. The separator member may be fixed within the chamber about its periphery at a preselected angle. Alternatively, the separator member may be at least partially rotatable so as to enable adjustment of the angle relative to the top of the chamber or the first outlet of the chamber or even the chute outlet. The angle of the separator member may be selected depending on the specific gravity of the ore to be separated. It will be appreciated that the angle of the separator member may assist in conveying the generally heavier ore particles, which migrate to or locate near the separator member, toward the second outlet for extraction thereof from the chamber. Accordingly, the location of the second outlet may be selected depending on the angle of the separator member relative to the first outlet. As such, the second outlet may be disposed in the same side wall of the chamber as the first outlet, alternatively the second outlet may be disposed in a side wall of the chamber that is opposite to or remote from the side wall in which the first outlet is disposed.

There is also provided a method of separating ore by means of a separator apparatus. The method may include the steps of: introducing ore into a separation chamber of the separator apparatus via a chute, the chute including an outlet for depositing ore within the chamber, the outlet of the chute being disposed lower in the chamber relative to a first chamber outlet so that the ore is introduced though the chute outlet into the chamber near an operatively bottom region of the chamber, and pulsating a fluid through ore deposited in the chamber resulting in the migration of generally lighter ore particles toward an upper region of the chamber and the migration of generally heavier ore particles toward the bottom region of the chamber.

A float (sometimes referred to as tailings) may be discharged from the first outlet, while a concentrate may be discharged from the second outlet. The desired mineral to be separated may be discharged via either one of the outlets depending on the density, size and chemical properties of the mineral. The float may comprise the lighter ore particles, while the concentrate may comprise the heavier ore particles. Ore particles may be deposited directly onto the separator member by the chute outlet thereby reducing the time that would otherwise be required for heavy ore particles to settle or sink towards the bottom region of the chamber where the separator member is disposed. As a result, the dimensions of the chamber may be significantly reduced, when compared to currently available systems, thus permitting the separator apparatus to be substantially portable.

A specific example embodiment of the separation apparatus is now described in greater detail with reference to the accompanying figures, wherein like reference numerals are used to indicate like features.

FIGS. 1 to 4 show various views of a separation apparatus (10) according to an example embodiment. The separation apparatus (10) includes a separation chamber (12) which may be box-like in shape and which includes a bottom (14), an open top (16) and four side walls (18). A permeable separator member (20) is mounted or otherwise attached to the side walls (18) of the chamber (12) within the bottom or lower region (22) thereof. The separator member (20) is mounted at an angle (a) relative to the bottom (14), the top (16) or to a first outlet (24) provided in an upper region (25) of the chamber (12). The separator member (20) may be fixed at a particular angle (a) or it may be mounted in a way which permits adjustment of the angle (a), as may be required. The angle (a) may be selected depending on the specific gravity of the ore particles to be separated. The separator member (20) may be in the form of a permeable or porous plate or grid through which a pulsating fluid, typically water, may be pulsed, as will be described in more detail further below. The first outlet (24) includes a first spout (26) that extends away from the separation chamber (12). A second outlet (28) is provided in the bottom region (22) of the chamber (12) near the bottom (14) and generally adjacent the separator member (20) and includes a second spout (30) which also extends away from the chamber (12). The location of the second outlet (28) and second spout (30) may be changed depending on the angle (a) at which the separator member (20) is mounted relative to the bottom (14), the top (16) or the first outlet (24). As such, the second outlet (28) may be provided in the same side wall as the first outlet (24) or it may be provided in a side wall opposite to or remote from the side wall in which the first outlet (24) is provided.

In addition, a fluid pulsing mechanism (32) is provided in the bottom region (22) of the chamber (12), disposed near the bottom (14) of the chamber (12) and below the separator member (20). In the embodiment shown, the fluid pulsing mechanism (32) is connected to a shaft (34) that extends through the bottom (14) of the chamber (12) and which in turn is connected to a drive mechanism (36), such as an electrical or mechanical pump. The drive mechanism (36) is configured to move the shaft (34) in a vertical direction up and down, thereby moving the fluid pulsing mechanism (32) vertically within the chamber (12). In use, as will be described in more detail below, the chamber is substantially filled with a pulsing fluid, typically water, and the vertical movement of the fluid pulsing mechanism (32) causes the fluid to be pulsed generally vertically through the separator member (20) and any ore (not shown) that may be deposited thereon. Pulsation of the fluid through the ore may result in at least partial suspension of the particles, thereby causing the generally heavier particles to migrate to the bottom region (22) of the chamber (12) while the generally lighter particles migrate to the upper region (25) of the chamber.

An ore deposit chute (38) is provided and extends through the open top (16) to the bottom region (22) of the separation chamber (12). The chute (38) comprises an inlet (40), which is generally disposed externally of the chamber (12), and an outlet (42) that is generally disposed in the bottom region (22) of the chamber (12) via which ore may be deposited in the bottom region (22) of the chamber (12), preferably directly onto the separator member (20). The outlet (42) of the chute (38) is disposed lower in the chamber (12) than the first outlet (24) of the chamber (12) with the outlet (42) of the chute (38) being generally disposed near a side wall of the separation chamber (12) that is remote from or opposite to the side wall in which the first outlet (24) is provided. In a preferred embodiment and as shown in the Figures, the chute (38) is provided internally of the chamber (12) and extends through the open top (16) into the chamber (12) along a side wall thereof. However, the chute may be provided externally of the chamber (12) in which case an opening or inlet in the chamber may be provided that communicates with the outlet (42) of the chute (38) to enable ore being deposited in the lower region (22) of the chamber (12). In addition, in a preferred embodiment and as shown in the Figures, the chute (38) includes a trough (44) at its inlet (40) to facilitate introducing ore into the chute (38). The trough (44) may be integral with the chute (38) or it may be separate and secured to the chute (38) prior to use.

Furthermore, the chute's (38) position, in particular the position of the outlet (42) of the chute (38) within the separation chamber (12), may be adjusted by sliding the chute (38) vertically within the chamber (12). In order to facilitate such a position change, a number of longitudinal slots (46) may be provided in the side walls (18) of the chamber (12) to which the chute (38) is secured, with the slots (46) cooperating with suitable fastening means (48), such as bolts or the like, through which the position of the chute (38) within the chamber (12) may be adjusted. It should be appreciated that in an embodiment in which the chute is provided externally of the chamber, a similar adjustment mechanism may be utilised. However, in such an embodiment, the chamber will need to be provided with a number of openings or inlets that communicate with the outlet of the chute. Closures may be provided which then close the openings or inlets not in use so as to enable filling of the chamber with the pulsating fluid.

Finally, the chute (38) preferably tapers outwardly along its length from its inlet (40) to its outlet (42). Tapering the chute (38) in this way may facilitate the flow of ore through the chute since ore introduced into the chute (38) may be drawn out of the chute (38) during the downward pulse of the fluid pulsing mechanism (32). It will be appreciated that during the upward stroke of the fluid pulsing mechanism, the fluid will compress the ore into the chute. Nevertheless, during the downward stroke, a suction is created by the fluid pulsing mechanism which results in ore being drawn out of the chute and thus preventing any blockage within the chute (38).

In use, the apparatus (10) is utilised in a mineral processing method or a method of separating ore. The ore to be separated is introduced into the trough (44), typically by means of a conveyor mechanism (not shown) such as a conveyor belt and is then channeled through the chute (38) into the chamber (12) and via the outlet (42) of the chute (38) deposited onto the separator member (20). In addition, the chamber (12) is substantially filled with a pulsing fluid, such as water, with the water level typically being just below the first outlet (24). It will of course be appreciated that during the separation process water will be discharged from the chamber and a continuous flow of water into the chamber will be required to maintain the water level in the chamber. When engaged, the pulsing mechanism (32) pulses the pulsating fluid through the permeable separator member (20) and the ore deposited thereon. As a result, ore deposited on the separator member (20) is pulsed or projected upward, away from the separator member (20), causing the ore particles to be at least partially suspended in the fluid for a period of time. As a result of the different specific gravities of the ore particles, the generally lighter ore particles migrate toward the upper region (25) of the chamber (12) and the generally heavier ore particles migrate toward the bottom region (22) of the chamber. In order to increase the time that particles remain suspended, so as to ensure that the lighter particles migrate upwards and the heavier particles downwards, a constant upward fluid current may be provided through the chamber, as is well known in the art.

In the embodiment shown in the Figures, the chute (38) is located adjacent the side wall of the chamber (12) that is opposite to the side wall in which the first and second outlets (24, 28) are provided. In addition, the separator member (20) is angled such that the separator member (20) slopes downwardly from the side at which the chute (38) is provided to the side on which the outlets (24, 28) are provided. The downward slope of the separator member (20) causes the ore deposited thereon to move in the direction of the arrow (A) shown in FIG. 3. During the upward stroke of the pulsing mechanism (32), the ore particles are pulsed upward and thus become suspended. During the downward stroke of the pulsing mechanism (32), the suspended ore particles settle and as a result of the slope of the separator member (20) the particles move in the direction of the arrow (A) and toward the first and second outlet (24, 28). Particles with a higher specific gravity will settle faster than particles with a lower specific gravity, thereby causing the lighter particles to migrate upwardly while the heavier particles settle lower in the chamber (12) and on top of the separator member (20). As the particles move toward the outlets (24, 28), the lighter particles or float, which have migrated upwardly, can be extracted from the chamber (12) through the first outlet (24) and the heavier particles, which have migrated downwardly or which have settled on the separator member (20), can be extracted from the chamber (12) through the second outlet (28). Extraction through the second outlet (28) may be by means of a vein, paddle or screw type extractor (50), as is well known in the art, which is capable of extracting the ore particles and moving them in a desired direction.

Since the ore particles are deposited lower in the chamber relative to the first outlet (24) the majority of the heavier particles or a substantial portion thereof, are already in the bottom region (22), i.e. on the separator member (20), and thus do not first have to migrate downward. Accordingly, only the lighter particles need to migrate upwards, which significantly reduces the time required to separate the particles.

It will be appreciated that the time required to separate the particles is directly linked to the size of the chamber (12). The necessary maximum dimension (w) or size of the chamber (12) accordingly needs to be selected such that the dimension is sufficient for the heavier particles to migrate downwardly through the layer of ore in the chamber until they can be extracted from the chamber. Since, in the present case, the particles are deposited directly onto the separator member (20), i.e. not simply introduced from the top of the chamber, only the lighter particles need to migrate upwardly and hence the dimension (w) of the chamber may be significantly reduced when compared to current systems. It will be appreciated that the time required to separate the particles is dependent on the pulse frequency, the pulse length as well as the size and specific gravity of the particles. Furthermore, particles having a lower specific gravity react better or travel more when exposed to a pulse as opposed to particles having a higher specific gravity. Accordingly, by depositing the heavier particles at the bottom of the chamber and only requiring the lighter particles, which react better to a pulse, to move upwardly, the time required for separation can be significantly reduced and thus the overall dimensions of the chamber can be reduced.

Because the required time for concentrating the ore may be less, there may correspondingly not be a need for a large chamber size to meet a similar ore processing rate. Thus, a more effective and/or efficient separation and/or concentration may be achieved with the invention described herein.

It will be appreciated that the angle (a) of the separator member (20) may be selected depending on the specific gravity of the particles to be separated. For example, as shown in the Figures, the separator member (20) is angled downwardly relative to the bottom (14) from the chute outlet (42) to the chamber outlets (24, 28), so as to cause the particles to move toward the second outlet (28). However, in another embodiment, the separator member (20) may be angled differently such that it is directed upwardly relative to the bottom (14), in which case the second outlet (28) would be provided on the opposite side of the chamber (12), i.e. opposite the first outlet (24) and in close proximity to the chute (38), so as to enable the heavier particles to be discharged from that side of the chamber (12).

Furthermore, due to the tapering of the chute (38) towards its outlet (42), the ore within the chute will be drawn out of the chute during the downward pulse of the fluid pulsing mechanism (32), resulting in the chute emptying and thus providing a further increase in ore processing capability of the apparatus (10).

In addition, it will be appreciated that the apparatus (10) may require significantly less electricity to power the pulsing mechanism (32) than currently available systems since the chamber size may be smaller and may hence require less water or fluid to be pulsated or pumped. The overall weight and cost of the apparatus may also be reduced and mechanical fatigue of the motor and the pulsing mechanism may be alleviated at least to some extent. As a result of the reduction in size of the separation apparatus, it may be portable or used in mobile applications such as on a mobile vehicle, vessel or craft. The significant benefit herein will be apparent. For example, in the case of diamond mining conducted offshore, the boats tend to collect the ore out at sea and then need to return to the harbour in order to offload the ore for separation purposes. The apparatus of the present invention will be small enough to be installed on a boat or vessel and hence separation of the ore can take place while the boat is out at sea. Accordingly, the boat will only have to return to the harbour with the mineral that is actually sought. This provides a significant time and energy saving. As described above, current systems are generally big, heavy systems that are substantially immobile. The combination of lesser fluid volume consumption, lesser energy requirement and reduced size thus provides for a cost effective solution that is able to operate in mobile environments such as aboard water-borne crafts or vessels or other mobile rigs, which may be impossible with prior art devices.

It will be appreciated that many other embodiments of a separation apparatus may be provided without departing from the spirit and scope of this disclosure. For example, many variations regarding the configuration and the materials used in the manufacture of, and the shape and configuration of the separation apparatus are possible. For example, the shape of the chute and method of position adjustment within the separation chamber may vary depending on the overall shape of the separation chamber and/or that of the chute. The chamber is depicted as being generally box-shaped, however rounded chambers are also possible. Also, as mentioned above, although the chute has been illustrated in the Figures to be internally of the chamber, it may of course also be provided externally, in which case the chamber would be provided with an inlet opening that would communicate with the outlet of the chute so as to enable depositing of ore into or near the bottom region of the chamber.

Figure 5:
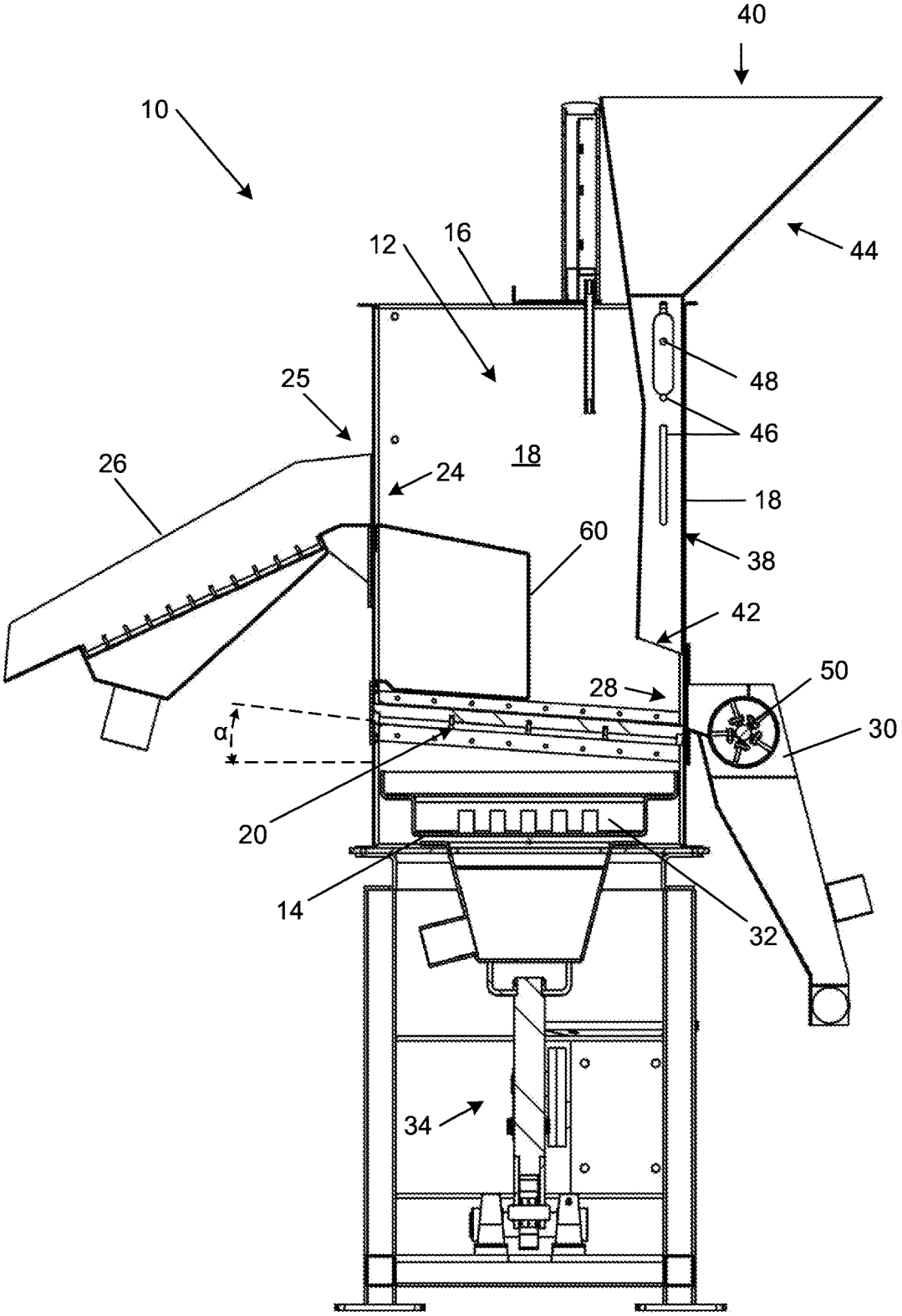
FIG. 5 is a sectional view of a separation apparatus according to an embodiment of the invention in which a blanking off plate is provided in the chamber.

Similarly, and as shown in FIG. 5, a blanking off plate (60) may be included in the chamber (12) which may reduce the size of the chamber (12). This may be particularly useful when particles having a very high specific gravity are being separated since even though the size of the chamber (12) may be reduced, the pulse volume will stay the same thus increasing the pulse length. Thus, the volume of fluid and ore within the chamber may be reduced, but the pulsing action is maintained, thereby exerting a substantially larger force onto the content of the chamber.

Nevertheless, and as shown in FIG. 5, use of a blanking off plate (60) will generally be limited to embodiments where the second outlet (28) and corresponding second spout (30) locate in a sidewall (18) opposite to that of the first outlet (24) and corresponding spout (26), i.e. on the same side as the chute (38), with the separator member (20) being angled to extend upwardly from the second outlet (28) toward the first outlet (24). This will ensure that the high specific gravity particles that settle at the bottom of the deposit on top of the separator member (20) can be conveniently extracted through the second outlet (28).

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention.

Throughout the specification and claims unless the contents requires otherwise the word 'comprise' or variations such as 'comprises' or 'comprising' will be understood to imply the inclusion of a stated integer or group of integers but not the exclusion of any other integer or group of integers.

The invention claimed is:

1. A separation apparatus comprising:

a separation chamber having a wall, a top opening and a bottom defining an interior cavity having a bottom region adjacent the bottom of the separation chamber and an upper region above the bottom region opposite the bottom of the separation chamber with the bottom region therebetween, a permeable separator member in the bottom region of the cavity, a first chamber outlet in the wall and in the upper region of the cavity and a second chamber outlet in the wall and in the bottom region of the cavity such that the second chamber outlet is closer to the bottom of the cavity than the first chamber outlet, a fluid pulsing mechanism below and adjacent the bottom of the chamber for operatively pulsating a fluid within the cavity and through the permeable separator member, and an ore deposit chute is provided through which ore may be deposited into the chamber, the chute including a chute inlet and a chute outlet closer to the bottom of the cavity than the chute inlet, the chute outlet closer to the bottom of the cavity than the first chamber outlet such that ore deposited into the chute inlet causes ore to be deposited in the bottom region of the cavity remote from the first chamber outlet, and wherein the chute widens from the chute inlet toward the chute outlet thereof thereby operatively causing ore to be drawn out of the chute and into the cavity during a downward stroke of the fluid pulsing mechanism.

2. The separation apparatus as claimed in claim 1, wherein a trough is provided at the chute inlet.

3. The separation apparatus as claimed in claim 1, wherein a conveyor mechanism is secured to the chute inlet for feeding ore into the chute.

4. The separation apparatus as claimed in claim 1, wherein the chute outlet is operatively submerged in the fluid.

5. The separation apparatus as claimed in claim 1, wherein the chute extends through the chamber from the upper region to the bottom region with the chute gradually widening from the chute inlet to the chute outlet.

6. The separation apparatus as claimed in claim 1, wherein the permeable separator member is secured within the chamber at an angle ($\alpha$) relative to the first chamber outlet.

7. The separation apparatus as claimed in claim 6, wherein the permeable separator member is at least partially rotatable so as to enable adjustment of the angle (a).

8. The separation apparatus as claimed in claim 1, wherein the permeable separator member comprises a permeable plate through which fluid may be pulsed.

9. The separation apparatus as claimed in claim 1, wherein the second chamber outlet is located on the same side of the chamber as the first chamber outlet.

10. The separation apparatus as claimed in claim 1, wherein the second chamber outlet is located on a side of the chamber opposite or remote from that of the first chamber outlet.

11. The separation apparatus as claimed in claim 10, wherein a blanking off plate in the cavity to reduce a volume of the cavity while maintaining the pulse volume.

12. The separation apparatus as claimed in claim 1, wherein the fluid pulsing mechanism pulsates the fluid mechanically.

13. The separation apparatus as claimed in claim 1, wherein the fluid pulsing mechanism pulsates the fluid hydraulically by means of a flexible diaphragm or air operating on a fluid surface or a combination thereof.

14. The separation apparatus as claimed in claim 1, wherein the fluid pulsing mechanism is configurable so as to configure the velocity of the pulsed fluid and for the velocity of the pulsed fluid to be selected depending on the specific gravity and particle size of the material to be separated.

15. A method of separating ore by means of a separation apparatus, the method including the steps of:

introducing ore into a separation chamber of a separation apparatus, the ore being introduced through a chute having an inlet and an outlet with the outlet disposed lower in the chamber relative to a first chamber outlet so that the ore is introduced through the chute outlet into the chamber near an operatively bottom region of the chamber onto a permeable separator member, wherein the chute widens from the inlet to the outlet;

providing and pulsating a fluid through the permeable separator member from below and the ore introduced into the chamber resulting in the migration of generally lighter ore particles toward an upper region of the chamber and the migration of generally heavier ore particles toward the bottom region of the chamber, wherein the first chamber outlet is provided in the upper region of the chamber and a second chamber outlet is provided in the bottom region of the chamber; and extracting the generally lighter ore particles from the chamber through the first chamber outlet and extracting the generally heavier ore particles from the chamber through the second chamber outlet.

* * * * *